United States Patent [19]

Otting

[11] 4,441,341

[45] Apr. 10, 1984

[54] APPARATUS FOR TREATING TEXTILE MATERIALS

[75] Inventor: Billy J. Otting, Lafayette, Ga.

[73] Assignee: Otting International, Inc., Lafayette, Ga.

[21] Appl. No.: 361,037

[22] Filed: Mar. 23, 1982

[51] Int. Cl.[3] ..... D06B 1/06

[52] U.S. Cl. ..... 68/205 R

[58] Field of Search ..... 68/205 R; 118/684, 324, 118/325; 251/5, 6, 7; 239/551, 562, 567

[56] References Cited

U.S. PATENT DOCUMENTS

| | | | |
|---|---|---|---|
| 1,677,453 | 7/1928 | Jones | 251/7 X |
| 3,443,878 | 5/1969 | Weber et al. | 68/183 X |
| 3,570,275 | 3/1971 | Weber et al. | 68/205 R |
| 3,793,785 | 2/1974 | Austin | 251/7 X |
| 3,964,860 | 6/1976 | Leifeld | 68/205 R X |
| 3,969,779 | 7/1976 | Stewart | 68/205 R X |
| 4,034,584 | 7/1977 | Klein et al. | 68/205 R X |
| 4,170,958 | 10/1979 | Moser | 118/325 |
| 4,202,188 | 5/1980 | Gruber | 68/205 R |
| 4,267,712 | 5/1981 | Gruber | 68/205 R |
| 4,375,158 | 3/1983 | Eichmanns et al. | 68/205 R |

FOREIGN PATENT DOCUMENTS 978452 12/1964 United Kingdom .

*Primary Examiner*—Philip R. Coe

*Attorney, Agent, or Firm*—Kerkam, Stowell, Kondracki & Clarke

[57] ABSTRACT

A method and apparatus for treating textile materials, such as carpet, employs an applicator station having a number of spray jets for causing a plurality of streams of fluid to be fanned out into a corresponding plurality of fan shape sheets of spray directed to the surface of a roller. The spray jets are used to spray either air, dye or gum. The roller is mounted for rotation in a dye or gum trough and the jets spray air or other fluid to cause a pattern to be formed in the dye or gum film on the roller. The pattern is transferred to the face of the carpet by a doctor blade or, alternately, directly to the carpet face. The trough may be filled with gum in which case the jets spray dye onto the film of gum picked up by the roller. The trough may also be used for dyeing in which case a different color dye is applied by the jets or multiple roll applicator stations may be provided for multi-color and tone effects. Alternately, no trough is used and dye or gum may be applied by the spray jets to the roller.

15 Claims, 8 Drawing Figures

APPARATUS FOR TREATING TEXTILE MATERIALS

CROSS REFERENCE TO RELATED APPLICATIONS

Valve arrangements described herein are more particularly described and claimed in U.S. Patent application Ser. No. 86,392, filed Oct. 18, 1979 by the present inventor, and entitled "Pinch Tube Valve", now abandoned in favor of continuation application Ser. No. 279,954, filed July 1, 1981. The use of such valve arrangements are further detailed in U.S. applications "Jet Pattern Dyeing of Material, Particularly Carpet", Ser. No. 85,943, filed Oct. 18, 1979, by the present inventor, now abandoned in favor of Ser. No. 237,577, filed Feb. 24, 1981, and "Pattern Dyeing of Textile Materials Such as Carpet", Ser. No. 156,624, filed June 6, 1980 by the present inventor and Alfred Clifford. The aforenoted applications are assigned to the assignee of the present inventor and are hereby incorporated by reference.

BACKGROUND OF THE INVENTION

The present invention relates generally to pattern dyeing of textile material such as carpet. More particularly, the invention relates to pattern dyeing of continuously moving textile materials by the use of spray jets.

The dyeing of textile webs such as carpet is well known in the art, and is carried out by a variety of techniques. One common technique, for example, uses a roller and doctor blade arrangement whereby dye is picked from a trough by the roller which then transfers the dye to a doctor blade. The dye falls off the lower end of the inclined doctor blade whereupon it may contact a textile web moving perpendicular to the axis of rotation of the roller.

The following patents are representative of known roller and doctor blade textile dyeing arrangements:

| U.S. Pat. No. | Inventor(s) | Issue Date |
|---|---|---|
| 3,964,860 | Leifeld | June 22, 1976 |
| 4,170,958 | Moser | Oct. 16, 1979 |
| 4,202,188 | Gruber | May 13, 1980 |
| 4,267,712 | Gruber | May 19, 1981 |

The Leifeld patent discloses a textile dyeing method and apparatus which may use a series of oscillating interruptor blades to interrupt the dye to be deposited on the carpet. The dye may be interrupted by the interrupting blades in a varying manner on the roller or on the doctor blade to result in strips of dye being deposited on the carpet in a random fashion. In an alternate embodiment, a plurality of oscillating air jets are used to interrupt dye flow on an inclined plate.

The Moser patent discloses a roller and doctor blade arrangement wherein a plurality of air outlets are arranged in a rotating tube positioned above the doctor blade to allow its air flow to rearrange the dye film on the doctor blade. Alternately, the rotating air outlet tube may be disposed beyond the lower end of the inclined doctor blade to selectively blow dye into a dye reservoir as its drops from the blade instead of allowing it to drop onto the moving textile web.

The Gruber '188 patent discloses a textile dyeing apparatus having a roller and doctor blade arrangement wherein dye dropping off a doctor blade in a shroud is blown outward by a series of axially spaced spray jets to cause non-uniform application of the dye. The spray jets move during operation of the dyeing process in order to randomize the pattern on the carpet.

The Gruber '712 patent shows a textile dyeing apparatus having a roller and doctor blade arrangement wherein dye on the doctor blade is interrupted by a number of wiping elements attached to a rotating tube.

Recently, it has been proposed to print textile fabrics, including pile carpets, by the programmed spraying or jetting of plural colored dyes onto the surface of the moving fabric. Typical of such processes and apparatus, in addition to the aforenoted applications, are the process and apparatus described in U.S. Pat. Nos. 3,443,878; 3,570,275; 3,969,779 and 4,034,854; and British Pat. No. 978,452. Generally, such apparatus consists of a plurality of dye applicator bars or manifolds spaced along the direction of movement of the textile material and each containing multiple dye nozzles or jets extending transversely across the moving material. Each jet may be activated by suitable electric, pneumatic, or mechanical means to dispense dye onto the moving material, and pattern control to apply the dyes in a desired sequence may be accomplished by various conventional programming devices, such as mechanical cams and drums, coded punch tapes, magnetic tapes, computers and the like.

U.S. Pat. Nos. 3,443,878 and 3,570,275 also disclose specific means for applying jets of dyes to print a fabric by use of continuously flowing dye streams which are deflected by a stream of air or a mechanical deflector to permit impingement of the dye stream upon the fabric or recirculation to a dye supply reservoir.

It can be appreciated that in the pattern dyeing of pile fabrics, such as carpets and the like, it is highly desirable to be able to achieve very detailed, sharp, and intricate patterns such as are obtained by conventional weaving processes employing multiple colors of yarns and control of the individual yarns to form the pattern, e.g. an Axminster or Wilton weaving process. Therefore, in the pattern dyeing of pile fabrics utilizing plural streams of dye which are selectively applied to the moving fabric to pattern the same, it is extremely important in such highly porous materials to accurately locate the dye in accurate amounts in the pile yarns of the fabric. For example, to achieve by pattern dyeing the definition which can be obtained by the aforementioned weaving processes, it is desirable that the dye applied be in small enough amounts as to dye a single yarn or tuft, or equivalent area, without undesirably wicking or migrating into adjacent tufts of the pile surface. Obviously then, accuracy of amount and placement of dye in the pile fabric becomes extremely important in dyeing pile fabrics intricate patterns.

It can be appreciated that certain factors can detrimentally influence accurate positioning of the dyes in the pile fabric. The speed of movement of the fabric must be carefully correlated to the application of the dyes. If the carpet speed varies with respect to the time of application of the dyes, inaccuracies in placement obviously occur. Similarly, if the flow rate of the dye varies with respect to the movement of the carpet to which it is applied, undesirable shading and inaccurate placement problems result. Thus, applying the exact amount of dye to the exact spot on the carpet, e.g., enough dye to dye the full length of a single tuft of yarn, is a much sought for goal in pattern dyeing of carpets.

U.S. Pat. Nos. 3,969,779 and 4,034,854 represent an attempt to minimize problems resulting from variations in the speed of the fabric or the flow rate of the dye during application of the dye streams.

The apparatus of the '779 and '854 patents include a jet pattern dyeing machine having a plurality of gun bars each containing plural dye jets extending across the width of an endless conveyor. The gun bars are spaced along the conveyor, and textile materials are carried by the conveyor past the gun bars where dyes are applied to form a pattern thereon. The application of dye from the individual dye jets in the gun bars is controlled by suitably adapted pattern control means. The amount of dye applied to the pile fabric is controlled by application of the streams in repeating increments of dye, wherein all of the continuously flowing streams in a given gun bar are deflected simultaneously by an air jet at repeating intervals of time throughout the dyeing operation to apply the dye in discrete incremental spots or "shots", to the pile fabric. In this manner, a given area of the fabrics is dyed by repeated, intermittent applications of dye to the pile, instead of an uninterrupted continuous flowing stream of dye over the area and the dye blown away is collected. The '854 patent includes electromagnetically operated valves for controlling the flow of deflecting air.

Although the prior art systems have proven to be a useful tool to carpet stylists and manufacturers, they have been subject to one or more of a number of disadvantages. Prior art systems wherein dye is applied from troughs using rollers and doctor blades for transfer of dye to the carpet usually do not produce patterns with great resolution. It is extremely difficult to change the pattern produced by such prior art devices because of their reliance on mechanical positioning and movement of a scraper blade or spray jet. In order to change the pattern, access must be gained to the mechanical supporting arrangement to reposition the scraper blade or the air jet. Where the pattern is provided by a rotating air tube, the apparatus is limited to one pattern unless the air tube itself is changed or a number of the openings in the air tube are plugged, either procedure being somewhat cumbersome and time consuming.

Prior art systems which avoid reliance upon a roller and doctor blade arrangement, such as the aforenoted programmed spray or jet dyeing systems produce a finer and more desirable resolution pattern; however, they are disadvantageous in other respects. For example, they often require a separate dye recirculation reservoir whereby dye which is deflected by the air jet may be retrieved.

Moreover, the use of air jets to break up or blow away falling dye streams may atomize the dye and cause the dye to be deflected beyond the reservoir. This loss of dye is not only costly, but any atomization of the dye may cause the dye mist to enter the air. Final setting of the dye may be in undesirable locations. Additionally, the atomized mist may create health problems to subjected machine operators to breathe dye contaminated air. Special precautions must be taken to avoid this condition. Additionally, prior art devices are not generally designed to improve existing systems, but rather require complete replacement. A manufacturer having millions invested in a continuous line system employing troughs and rollers for dye application will generally want to improve his current machines, instead of scrapping his capital investments in his current system. Thus, since many patentable improvements are unsuited for use with prior art systems, they are not readily available, for economic reasons, to manufacturers employing conventional dyeing systems.

OBJECTS

Accordingly, it is a general object of the present invention to provide a new and improved carpet dyeing apparatus.

A further object of the present invention is to provide an apparatus for dyeing textiles such as carpets wherein spray jets may be used in conjunction with roll applicator dyeing apparatus.

A further object of the present invention is to provide an apparatus whereby a conventional roller and doctor blade dyeing arrangement of a continuous dye line may be easily retrofitted with spray jets so as to be capable of producing patterns on textiles such as carpets with a high degree of resolution or sharpness.

A still further object of the present invention is to provide an apparatus for dyeing textile such as carpet, wherein the pattern on the carpet may be quickly and efficiently changed without modification of the machinery.

SUMMARY OF THE INVENTION

These and other objects of the present invention, which will become apparent as the description proceeds, are realized by a method of dyeing a continuously moving carpet web which comprises transporting a carpet web, pile face up, past one or more dye applicating stations and applying dye to the pile face at one of said stations by means of a roller. Rearranged liquid film is transferred from the roller to a doctor blade in contact with the roller, and thereafter by gravity to the carpet web passing below a lower end of the doctor blade.

The spraying of the fluid is accomplished by a plurality of axially arranged stationary spray jets extending the width of the web. To this end, a plurality of spray jets are selectively opened and closed by a corresponding plurality of spray valves, one for each stationary spray jet to establish a predetermined pattern. The sprayed fluid may be a gas which pushes selected areas of the film away from that portion of the roller in the path of the spray gas. Alternately, the sprayed fluid may be a dye which displaces a different colored dye on the dye film away from that portion of the roller in the path of the sprayed dye.

The apparatus for dyeing a continuously moving carpet web according to the present invention comprises a spray head which may be retrofitted to a conventional continuous carpet dye line having one or more applicator stations which conventionally include a roller mounted for rotation about an axis in a dye trough and extending the width of the web. More specifically, a plurality of spray jets disposed in a line for spraying fluid on the roller to either rearrange a liquid film picked up by the roller from the trough or to apply fluid to the surface of the roller in a predetermined pattern. In the former arrangement, a doctor blade is positioned adjacent the roller for receiving dye from the roller. The doctor blade is inclined downward away from the roller and towards the carpet so that the liquid rolls off the lower end onto the pile face of the carpet web. The spray jets are stationary and each spray jet is controlled by one of a plurality of spray valves. A plurality of control valves, each control valve controlling fluid flow of a control fluid to a corresponding one of the spray valves, is further included.

Each spray jet terminates in a nozzle having a head which curves in two directions, forming a cupped fan by virtue of its concave surface which curves away from main axis, which is vertical in the mounted position. The cupped fan surface redirects and shapes the fluid spray against the roller to control the liquid pattern.

The apparatus further comprises a modular construction including a plurality of support member blocks. Each support member block supports a fixed number of spray valves and corresponding control valves and has a plurality of controlled fluid passages connecting each spray valve to the corresponding control valve. The support blocks are mounted remote of the spray set location for easy access for repair and replacement and each spray jet is connected to an associated fluid chamber by a flexible tube which passes through a corresponding one of the spray valves. The spray jets are disposed in a straight line transverse to the direction of travel of the carpet web and are sufficiently close together so that the spray pattern of each spray jet on the roller extends at least to the spray pattern of adjacent spray jets on the roller.

BRIEF DESCRIPTION OF THE DRAWINGS

The above and other features of the present invention will be more easily understood by reference to the included drawings wherein like reference characters represent like parts throughout and in which.

DETAILED DESCRIPTION OF THE PREFERRED EMBODIMENTS

Figure 1:
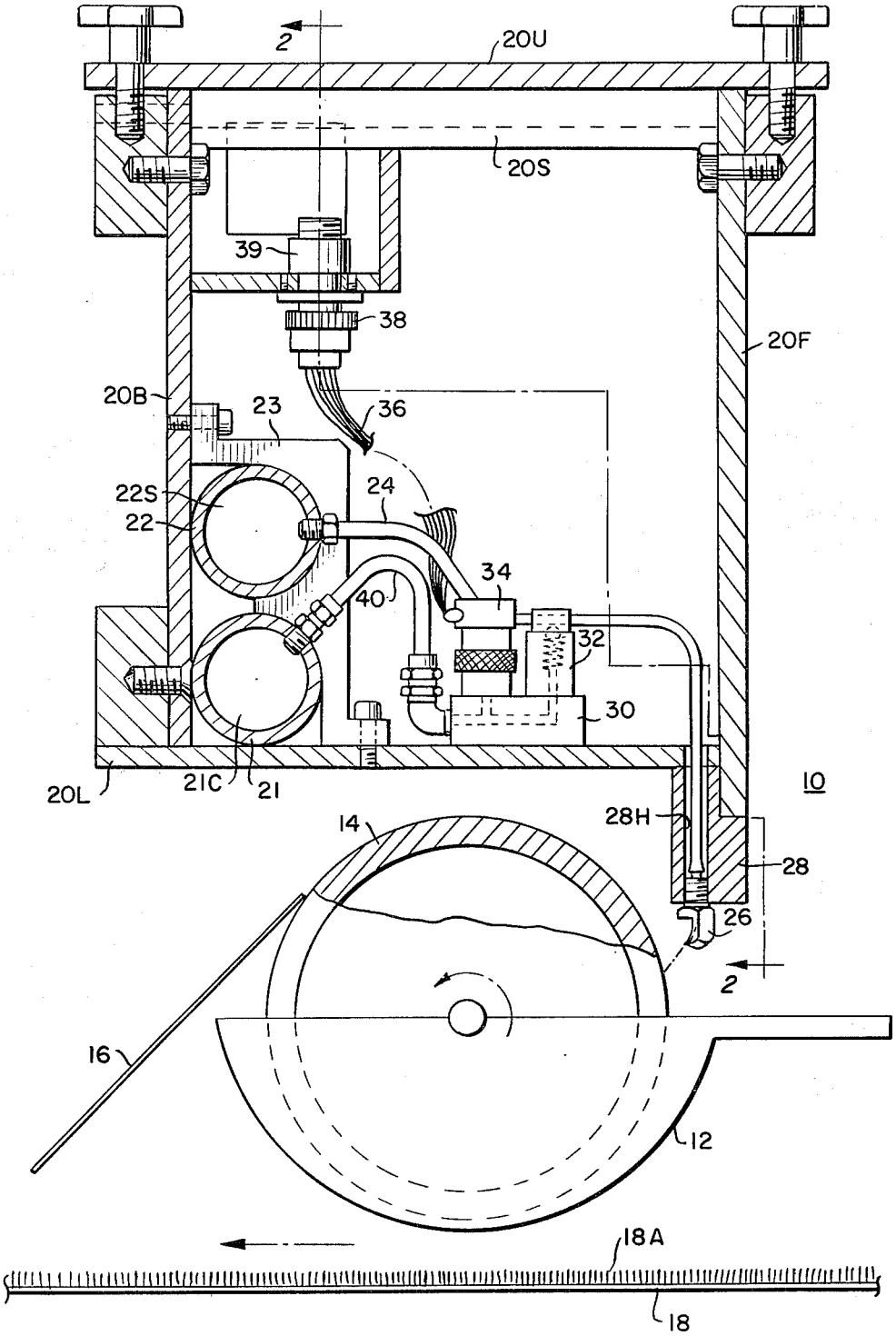
FIG. 1 shows a side view in partial cross section of the present invention.
Figure 2:
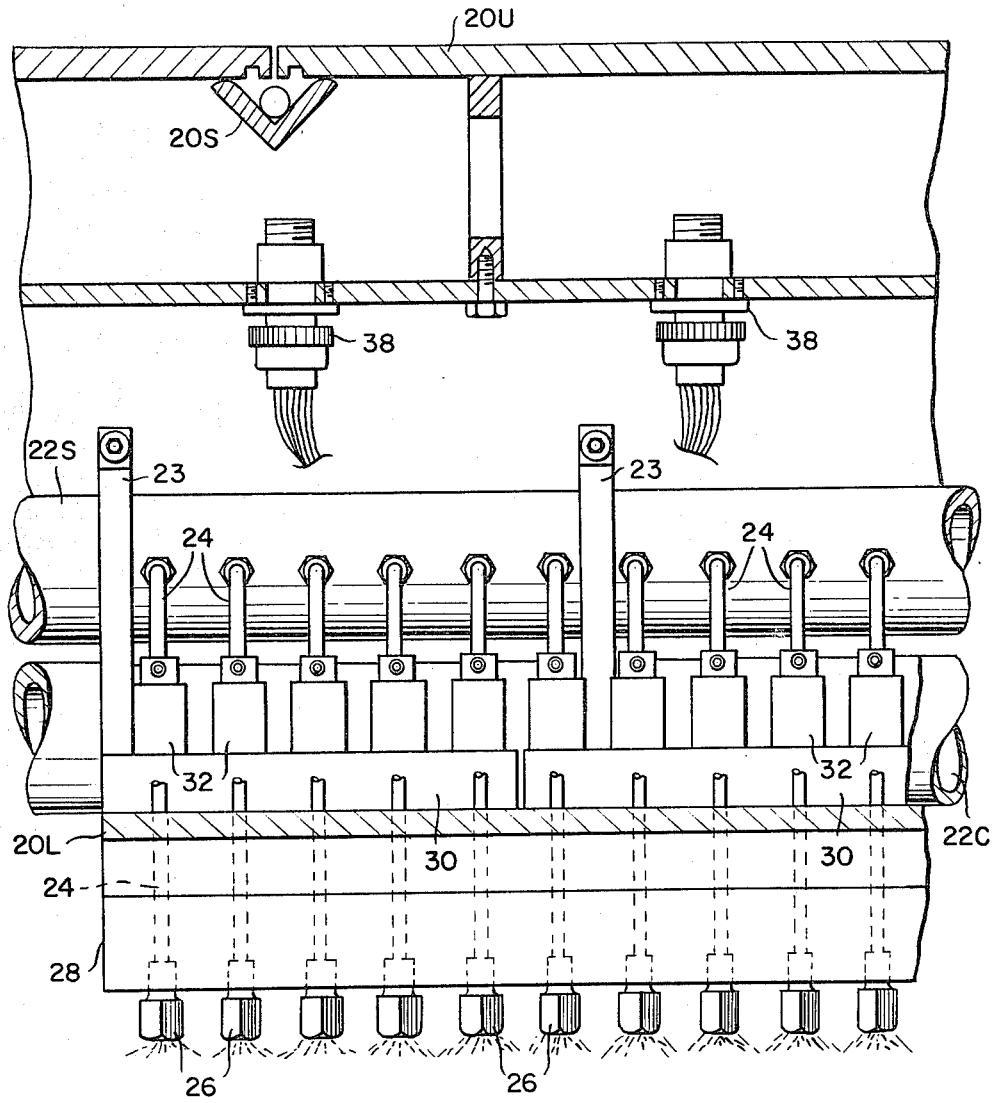
FIG. 2 shows a cross section view taken along lines 2—2 of FIG. 1.

Turning now to FIGS. 1 and 2, a preferred embodiment of the present invention will be discussed. FIG. 1 shows a side view with several parts in cross section of the spray jet apparatus of the present invention, whereas FIG. 2 shows a view taken along lines 2—2 of FIG. 1.

While the several figures show in detail the construction of the spray jet apparatus, it should be apparent that the invention is suitable for retrofitting into existing commercial continuous carpet dyeing systems. Such systems conventionally include a wet out station or chemical impregnation system at which the carpet web is pretreated to remove soil, yarn, oil and tint, as well as to impregnate the carpet with chemicals. The principal function of the wet out station is to render the carpet absorbent to rapid, even dyestuff application. The carpet web is thereafter conveyed or passed to one or more applicator units wherein there is applied to the face of the web, i.e., the pile yarn, gums, dye and the like, depending on the color and patterns selected. The applicator units may in the form of pattern roll printers or dye roll applicators. In the former case, the dye liquor is pressed onto the face of the web by means of a roll resembling the ball typing element of a typewriter. The roll is patterned with foam rubber pads adapted to be soaked with dye liquor stored in an associated dye pan. As the web passes over a roll which is rotated, the soaked pad presses against the web (a pressure roller is disposed on the back side of the web) to transfer the dye to the face of the carpet web. Multiple roll applicators are spaced along the direction of travel of the carpet web to apply different colors in a prearranged pattern. Another form of applicator consists of a steel roll rotating in a dye trough, with a doctor blade delivering dye from the roll to the carpet. Dye delivery is readily controlled by roll speed, dye liquor or viscosity and carpet speed. Pick up normally varies between 250–500% depending on web construction.

The dye impregnating liquor consists primarily of dyestuff, pH buffer system, foaming-leveling agent, and a thickening agent to facilitate uniform application of liquor to the goods and to hold the dye liquor in place until fixation can occur. Other chemicals are required at times, such as carriers for polyesters, compatibilizing agents when dyeing styling yarns with different classes of dyestuffs, etc.

Following dye application, the carpet web is conveyed to a steamer for dye fixation and thereafter to a wah box or rinse station to remove residual dyes, chemicals and gum, a dryer and a store station.

The dyeing apparatus according to the present invention is adapted for use as an applicator unit 10 in the aforedescribed continuous carpet dyeing system and includes in the preferred embodiment a dye trough 12, a roller 14 disposed within the dye trough 12 for picking up a dye film from the dye trough, and a doctor blade 16 for scraping off dye from the roller 14 and depositing it upon the pile face 18A of carpet web 18 moving in the direction shown by the arrows.

As shown in FIGS. 1 and 2, the trough 12, roller 14, and blade 16 are disposed above the carpet web and transverse thereto and extend the full width of the web.

Only a single trough 12, roller 14, doctor blade 16, and carpet 18 are shown in FIG. 1, for simplicity, the drive system and other parts of the continuous dyeing line being conventional and known to those skilled in the art. The roller 14 rotates in the direction shown about an axis perpendicular to the view of FIG. 1 and one or more applicator units 10 may be spaced along the direction of travel of the carpet web 18.

Figure 4:
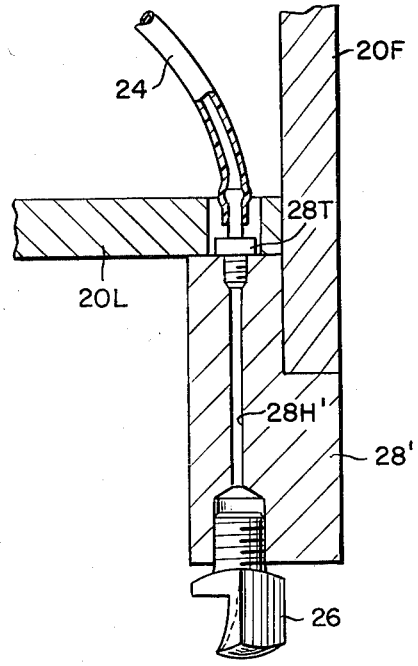
FIG. 4 shows an alternate construction, from the same view as with FIG. 1, of a part of the present invention.

Above the roller 14 is disposed an overhead support wall 20U to which are bolted front and back walls 20F and 20B, respectively. A lower wall 20L is attached to the front and back walls 20F and 20B. Cylinders 21 and 22 provide, respectively, a pressurized control fluid source 21C and pressurized spray fluid source 22S and are supported by support 23 and the walls 20B and 20L as shown. A number of spray fluid flexible tubes 24 extend between the pressurized spray fluid source 22S and a number of spray jet nozzles 26. The flexible tubes 24 may either connect directly to the corresponding spray jet nozzle 26 as shown in FIG. 1 wherein a jet support block 28 includes a hole 28H threaded at one end to receive the threaded end of a nozzle 26 and sufficiently large to accomodate a flexible tube 24 or it may be connected as shown in the alternate construction of FIG. 4 wherein the jet support block 28' includes threaded adapter members 28T which attach to the associated flexible tube 26 and allows the spray fluid to pass through restricted passageway 28H'.

Mounted to the lower wall 20L are a number of modular support member blocks 30, each one of which supports five spray valves 32 and five corresponding control valves 34. Each flexible tube 24 passes through a corresponding spray valve 32 to allow control of fluid sprayed from nozzle or spray jet 26, the pattern of which is controlled by the nozzle construction. Each of the control valves 34 is preferably a solenoid valve connected to be controlled by an electrical signal on wires 36 extending to plug 38. Jack 39 is conveniently connected to an external power and control source (not shown). Separate control fluid tube 40 connects the passages in each of the support member blocks 30 to the control fluid in cylinder 21C. Because the control fluid from pressurized control fluid source 21C is separately gated by the control valves 34, a single fluid tube 40 may be used to supply control fluid to all of the control valves 34 mounted on a particular support member block 30. For ease of illustration, the solenoid 34 and its wires and tubes 40 have been deleted from the view of FIG. 2.

Stretcher member 20S extends from the front wall 20F to the back wall 20B as shown and provides additional mechanical support and rigidity for the walls.

Figure 3:
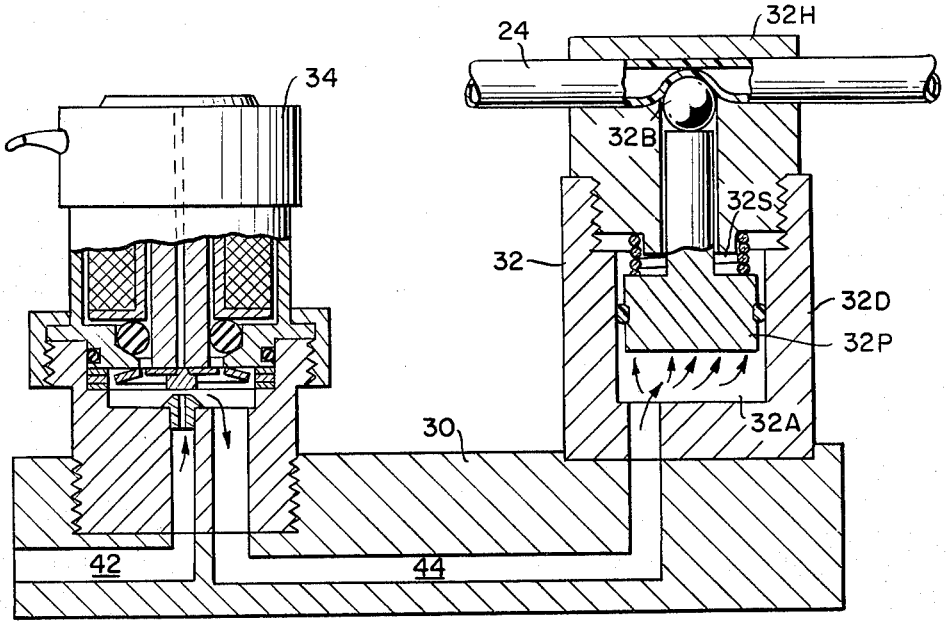
FIG. 3 shows a cross section view taken along lines 3—3 of FIG. 2.

FIG. 3 shows a fragmentary side view in cross section of the support member block 30 with one of the support valves 32 and one of the control valves 34 also shown in cross section. Although the operation of the control valve 34 and corresponding spray valve 32 is explained in detail in the incorporated by reference application Ser. No. 279,954, it will be briefly summarized here.

Control fluid from the pressurized control fluid source 21 may simply be pressurized air at 60 pounds per square inch of pressure. This control fluid is fed into passage 42 formed in block 30 which serves to distribute the control fluid to the five solenoid valves 34 mounted on a particular support member block 30 through a corresponding solenoid valve 34 and connecting passage 44. When one or more of the solenoid control valves 34 is (are) actuated, pressurized control fluid may pass from the passageway 42, through the energized valve(s) into a particular control fluid passage 44 leading to the particular spray valve 32 corresponding to an energized control valve 34. Since a single control tube is utilized, passage 42 to each valve 34 may be in common, control fluid being passed to a control fluid passageway 44 only when a valve 34 is opened. The support member block 30 includes five separate control fluid passages, each corresponding to one of the five corresponding pairs of spray valves 32 and control valves 34. When the control fluid enters the bore 32A of spray valve 32, it will cause piston 32P to be displaced against the bias of spring 32S, thereby causing ball 32B to pinch tube 24 and cut off the flow of spray fluid in the flexible spray fluid tube 24. The spray valve 32 may include a head portion 32H which threads into a body portion 32D. The body portion 32D may in turn be threaded into the support block 30 (threads not shown). Alternately, instead of having separate body portons 32D for each of the valves 32 as is shown in FIG. 2, a single block (not shown) could be used for all five of the valves attached to a particular member block 30. The block corresponding to the five body portions 32D could simply be welded or otherwise attached to the support member block 30. Alternately, each of the body portions 32D could be integral with the support member block 30. However, recognizing the advantages of modular construction and capability of rapid replacement of defective parts, in the preferred embodiment each body portion is threaded into a preset hole in the block to establish communication between the control fluid service 21C and bore 32A via channels 42 and 44 and an open valve 34.

Figure 5:
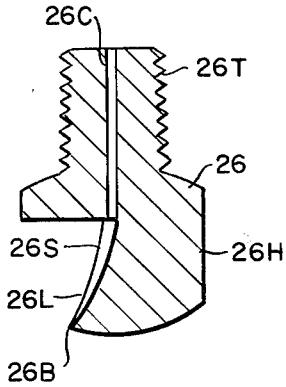
FIG. 5 shows a cross section side view of a spray jet according to the present invention.

FIG. 5 shows a side view in cross section of a spray jet or nozzle 26 used in the present invention. As shown, the spray jet includes threaded shank portion 26T and had portion 26H having spray surface 26S, which is curved in both horizontal and vertical directions. The curvature controls the shape of spray pattern so that it is relatively small width in the plane of FIG. 5 (or the parallel plane of FIG. 1) and a sufficiently wider width or spread normal to the plane to allow spray from each spray jet to extend at least to the limit of the spray from an adjacent spray nozzle as it hits the roller. For example, if each spray jet 26 is 1" center-to-center apart from its adjacent spray jets, then the spray will spread to at least a 1' width on the roller surface perpendicular to the plane, that is to say, it will form a continuous line.

Figure 6:
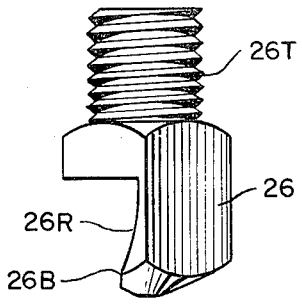
FIG. 6 shows a side elevational view of a spray jet according to the invention.
Figure 7:
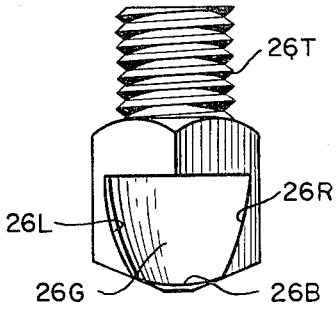
FIG. 7 shows a front elevational view of the spray jet of FIG. 6.

FIG. 6 shows a full side elevational view of nozzle 26, while FIG. 7 shows a front elevational view of spray jet or nozzle 26. Surface 26S is concave and curves away from the central vertical axis toward the roller 14. This gives a scoop effect to the nozzle and a spray directing surface which may be characterized as a cupped fan surface defined by side edges 26L and 26R and bottom edge 26B. As the spray liquid enters channel 26C in nozzle 26, it exits at the uppermost center point of the surface 26S which, by virtue of its cupped fan shape, causes the column of liquid to fan out into a fan shaped sheet of spray approximately one inch in width as shown in FIG. 2. With the valves arranged so that one of the planes is parallel to the axis of the roller 14, the dye or other liquid can be applied in a substantially straight line extending across the length of the roller as shown in FIG. 2.

Figure 8:
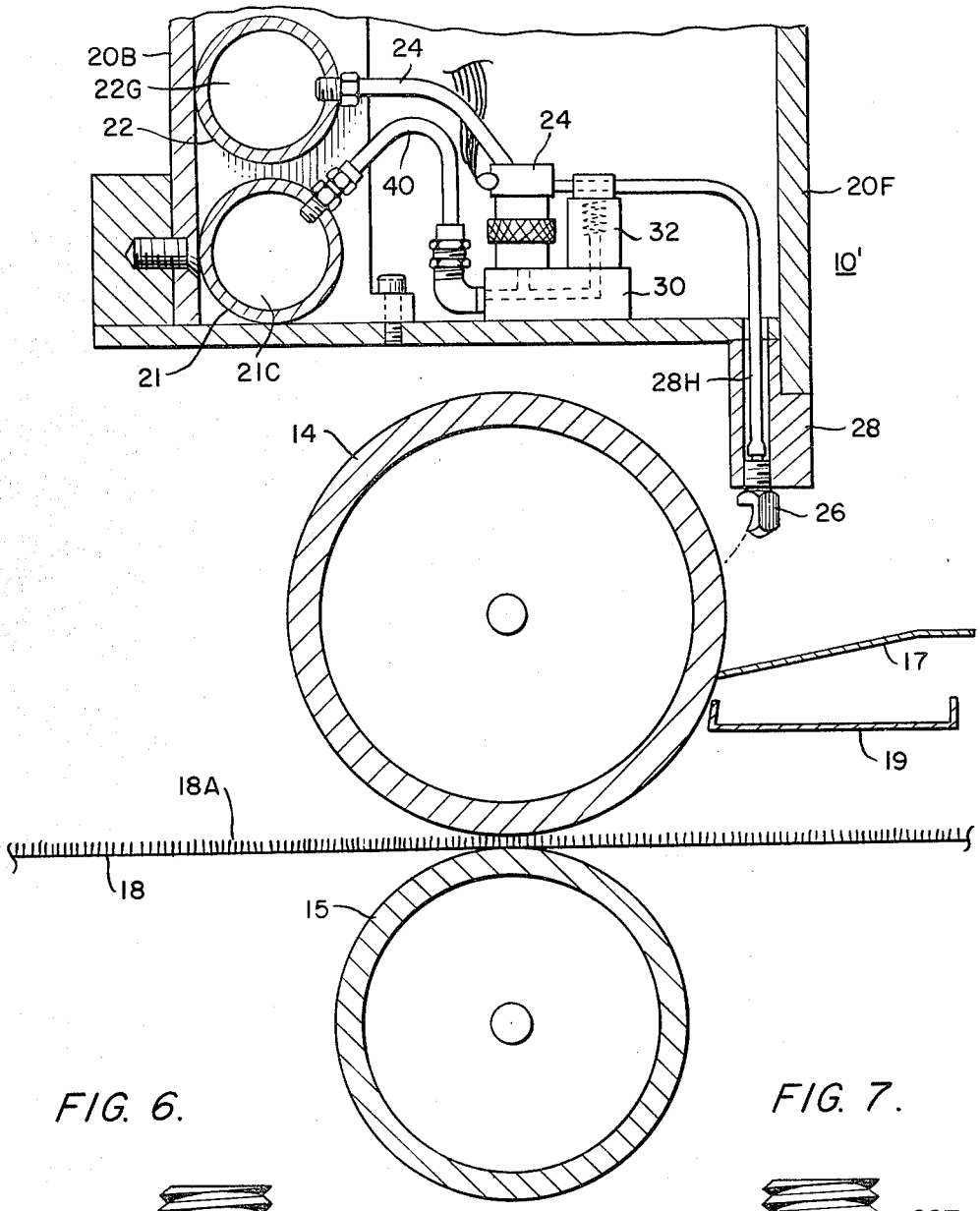
FIG. 8 shows an alternate embodiment of the invention wherein the roll applicator is used for printing a design on a carpet.

FIG. 8 shows an alternate embodiment of a roll applicator 10' wherein a printing roll 14' is utilized. For convenience, like reference characters have been utilized to identify parts identical to those of FIG. 1. It can readily be seen that the doctor blade 16 and trough 12 of FIG. 1 have been deleted, and a pressure roller 15 added beneath carpet web 18. Liquor dye or gum are applied directly from spray nozzle 18 in a controlled pattern on the surface of drum 15 as it is driven past spray valve 26. Continued rotation of the drum causes the liquor dye or gum to be transferred to the pile face 18A of the carpet. A scraper 17 and catch pan may be utilized to remove excess dye from the roller and return it by suitable conduit means (not shown) to a reservoir. Alternately, the dye or other liquid could be picked up from a trough (not shown) and rearranged by the spray jets spraying air or other spray fluid. In such an arrangement, the carpet 18 may have to be inverted in part of its path so that carpet face 18A could contact roller 15 without the trough in its way.

Operation

Considering now all of the figures, the operation of the present invention will be discussed. As a carpet web 18 is conveyed in the direction of the arrow shown in FIG. 1, it passes one or more roll applicator units, each having a roller 14 that picks up a liquid base film from trough 12 as the roller is rotated. Fluid (gas or collected liquid) from the jet spray nozzles 26 is directed unto the liquid base film collected on the rotating roller 14. Preferably, the liquid in the trough is a dye liquor, but it could be another liquid such as a gum, for example, adapted to receive thereon a dye liquor. Thus, the spray from spray jets directed against the roller will cause a pattern to be formed on the continuous film, either by causing areas of the film to be pushed aside or by adding dye liquor on the gum.

A photo cell pattern controller, a digital computer, or similar device (not shown) connected to jack 39 may be used to generate electrical signals over conductors connected to plugs 38, thereby selectively opening and closing the control valves 34. The opening or closing of a particular control valve 34 will respectively cause the closing or opening of the corresponding spray valve 32, thereby turning off and on the flow of the spray fluid in flexible tube 24. The corresponding nozzles 26 will thus be turned on and off to cause the pattern of dye to be formed on the roller 14. Most importantly, the stationary spray jets 26 are disposed in a straight line and are sufficiently close together that the spray of each spray jet 26 on the roller extends at least to the spray of adjacent spray jets on the roller. By establishing the pattern on the roller 14, the liquid will be transferred to the doctor blade and by virtue of its high viscosity fall off the doctor blade 16 onto the carpet 18 in the established pattern which is easily changeable by control of the valves. In the alternative, the fluid sprayed from spray jet 26 may preferably be simply pressurized air and may, for example, have the same source of pressurized air as the pressurized control fluid source 21C. When the fluid sprayed from the spray jet 26 is air, the air will displace or rearrange dye away from that portion of the roller 14 which is in the path of the particular spray 26 which is spraying, thereby generating a pattern. Since each of the spray jets 26 sprays at least to the edge of the spray of the adjacent spray jets, a relatively high degree of resolution can be obtained.

As an alternative to using air as the spray fluid, multiple color effects can be obtained by using dye as the spray fluid. In this case, spray fluid source 22S would include dye under pressure which is fed into the spray jets 26 depending upon the control signals on lines 36. The dye sprayed out of spray jets 26 would tend to displace or rearrange that portion of the gum or dye base film, as the case may be, on roller 14 in the path of the sprayed dye. The gum or dye liquid base film would have been picked up from trough 12.

Although the present embodiment shows the spray jets 26 disposed at the front of the roller 14 (where the roller rotates up in FIG. 1), the present invention contemplates that the multi-color effects achieved by spraying dye may preferably be realized by spraying the dye from spray nozzles 26 towards the back (where roller rotates down) of the roller 14 on the surface defined between the vertical axis and the point where the top of the doctor blade is positioned against the roller.

If desired, the doctor blade 16 and/or cutter blades (not shown) in between the doctor blade and the carpet may oscillate parallel to the rotation axis of roller 14 in a manner well-known in the art. However, such mechanical movement is not necessary to randomize a pattern. Random pattern effects, as well as detailed intricate designs, may be achieved by control of the spray jets.

It will be appreciated that the particular pile or web being treated may vary widely including e.g., woven or knitted fabrics, or other kinds of fabricated materials known in the art.

The pile face of the fabric is also selected from materials known in the art and may include substantially any type of continuous filament or fiber. For example, these may comprise synthetic or man-made continuous filaments or spun fibers, such as polyamides in their various forms, i.e., nylon 501, etc., polyolefins, acrylics, polyesters, rayon, etc. Natural fibers such as cotton, wool etc., may also be used. The pile face may be cut or uncut loop. It may be shag or plush, or any one of the known forms presently available. The height or depth of the pile face may vary within relatively wide limits.

The specific nature and type of the dye or coloring material which is applied to the pile face also may vary widely in carrying out the present invention. Dye selection is determined by the type and nature of the filaments or fibers which are used in the pile face; the purpose of the pile carpet; the result or effect to be obtained, etc. As known in the art, acceptable dyes for use with cellulosic fibers include vat dyes, sulfur dyes, azoic dyes, reactive dyes, etc. Dyes for polyamide nylon fibers include acid dyes, premetalized dyes, disperse dyes, direct dyes, reactive dyes, etc. Dyes for wool are vat dyes, reactive dyes, acid dyes, direct dyes, etc. These dyes are conventional and are known in the art. Examples of typical dyes are Yellow S.L., Red G and Blue 2G.A.

Further dyes include the Irgalons of Ciba Geigy such as Yellow D.R.L., Black B.G.L., Red 2G.L., etc.; the Resolin dyes manufactured by Verona such as Blue F.B.L., Red F.B., Yellow 4G.L., etc.; the Nylosan dyes manufactured by Sandoz such as Blue 2A.L., Red E2GN, Yellow E.L., etc.; the Stylacyl dyes manufactured by DuPont such as Red R.B., Red R.Y., Blue R.P., Yellow R.G.; the Merpacyl dyes manufactured by DuPont such as Yellow S.L., Yellow 9G., Red B, Red G, Blue 2G.A., Blue S.W., etc.; the Sevron dyes manufactured by DuPont such as Red L., Yellow 3R.L., Yellow 8GMF, Blue A.C.N., etc., and any such dyes suitable for the fiber being dyed.

In the practice of the invention, the fluidity or viscosity of these dyes is preferrably adjusted by the addition of an aqueous media or a viscosity control agent or thickener, such as Syngum D-47-D, gum guar, gum karaya, Halltex KRS-H, etc. A few typical dye formulations are:

(1) Yellow RGLL: 60 grams per 20 Liters
(2) Red F4BLL: 4.5 grams per 20 Liters
(3) Blue BRL: 3.0 grams per 20 Liters These dye formulations are mixed with Syngum D-47-D, 0.5 grams per liter, at a pH of about 3.0.

As should also be appreciated by those skilled in the art, the precise apparatus, including, e.g., the means for conveying the pile web prior to the application of the dye as well as the means for fixing the dye (typically a steamer) and washing the dyed fabric, is not critical to the practice of the present invention.

In this regard, however, the present invention is particularly suitable for use in combination with the teachings of U.S. Pat. applications No. 4,127,014 and is particularly adapted to replace the viscous gum roll applicator or the splatter dye applicator shown respectively in FIGS. 2 and 5 of Pat. No. 4,127,014.

In summary, the disclosure of the Pat. No. 4,127,014 relates to the production of a non-repetitive color pattern in pile fabrics wherein the traveling web is coated, prior to the application of the dye, with a thick viscous water-soluble barrier or layer. This layer is applied evenly over the entire pile face of the web. Thereafter, the liquid dye is dripped onto the viscous coating or layer. The viscous coating, which may comprise a natural or synthetic gum including, for example, gums, resins, collodial polysaccharide substance, starch, etc., serves to resist the initial penetration of the dye into the pile. The dye drippings form numerous small pools and/or rivulets of varying shapes or designs on the viscous coatings.

In this regard, FIG. 1 of the present invention illustrates a particularly suitable arrangement of the apparatus that may be employed in the present invention and which combines the steps of applying the thick viscous coating or layer and the dye onto the moving web by a single roll applicator. With reference to FIG. 1, a pile web such as a tufted carpet, is advanced in the direction of the arrow beneath the roll applicator 10 which may have its trough 12 piled with a viscous gum. Roller 14 is mounted in the trough with a portion below the level of the gum for applying a thick viscous coating or shield of a chemically inert water soluble natural or synthetic gum, continuously and uniformly over the entire plie face of carpet web. The coating is such that it has a viscosity of the order of from between about 1000 to 10,000 cps and preferably from between about 3000 to 5000 CPS. Viscosities from between about 1000 to 10,000 have been successfully employed to obtain very distinct and different color effects although other viscosities may be successfully used. Example of coating materials include the aforesaid natural or synthetic water-soluble gums which are employed in this industry as thickening agents for dyes. A specific example includes SYNGUM D-47-D produced by Stein Hall Company. The viscous coating preferably has a thickness on the order of about $\frac{1}{8}$ inch. Such gums are well known commercially.

As shown in FIGS. 1 and 2 the dye application station is mounted above the elevation of the carpet web and includes a plurality of cupped nozzles which serve to spread or fan the streams of dye directed through passage 28H and direct the dye toward the roller and onto the film of gum. The dye so deposited is arranged in a predetermined pattern and travels with the gum until it is removed by doctor blade 16 and deposited on the face 18A of web 18.

Following the application of the gum and dye onto the pile face, the carpet or web is passed directly toward and into a steamer (not shown). If the viscous gum shield or coating is applied to the carpet prior to the application of the dye, it has its viscosity quickly reduced in the steamer such that it disintegrates and settles into the carpet pile with the dye upon it.

The heated environment of the steamer causes the fixing of the dyes in the carpet pile fabric. The steamer serves a dual function, namely the fixing of the dye while simultaneously causing the melting or disintegration of the viscous coating and the resulting settlement thereof. When the viscous coating is applied, it forms a temporary barrier to the penetration or settlement of the liquid dye into the carpet pile. While this barrier action is taking place, the sprayed dye on top of the barrier is forming the ultimate pattern for the dye in the carpet pile after the disintegration of the viscous coating. The color patterns obtainable by the instant invention are almost limitless when the aforesaid viscous shield is applied and very delicate in their blending and halo effects.

Although specific materials and constructions have been discussed herein, it is to be understood that these are for illustrative purposes only. Various modifications and adaptations will be readily apparent to those having ordinary skill in the art and may be made without departing from the spirit of the invention or the scope of the claims appended hereto to which reference should be made for a complete appreciation of the full scope of the invention.

What is claimed is:

1. Apparatus for dyeing a continuously moving textile web comprising a roll applicator extending the width of the moving textile web and adapted to be mounted above the moving textile web, said roll applicator including a trough for supplying liquid dye, a roller mounted for rotation in said trough and adapted to pick up the dye in a film on a surface of the roller upon rotation of the roller, a doctor blade adjacent said roller and inclined downwardly away from said roller for transferring dye from said roller to said web, and a plurality of spaced spray jets for spraying gaseous fluid on said roller to rearrange said dye film.

2. The apparatus of claim 1, wherein each spray jet includes a cupped surface for fanning out the sprayed gaseous fluid into a fan shaped sheet of spray.

3. The apparatus of claim 1 wherein said spray jets are stationary.

4. The apparatus of claim 1 further including a plurality of spray valves, each spray valve controlling gaseous fluid flow to a corresponding one of said spray jets.

5. The apparatus of claim 4 wherein said spray jets are mounted for spraying gaseous fluid onto a front side of said roller.

6. The apparatus of claim 4 wherein said spray jets are mounted for spraying gaseous fluid onto a back side of said roller.

7. The apparatus of claim 4 further including a plurality of control valves, each control valve controlling fluid flow of a control fluid to a corresponding one of said spray valves.

8. The apparatus of claim 7 further including a plurality of support members, each support member supporting at least one spray valve and a corresponding control valve and including a control fluid passage connecting said at least one spray valve to the corresponding control valve.

9. The apparatus of claim 8 wherein each support member supports a plurality of spray valves and corresponding control valves and includes a plurality of control fluid passages connecting each spray valve to the corresponding control valve.

10. The apparatus of claim 7 further including a flexible tube connecting each spray jet to a source of fluid, each said tube passing through a corresponding one of said spray valves.

11. The apparatus of claim 10 wherein each spray valve includes a spring-biased piston and a freely-rotatable ball for pinching off fluid flow in the corresponding flexible tube, said ball movable by movement of said piston.

12. The apparatus of claim 1 or 4 wherein said spray jets are disposed in a straight line and are sufficiently close together such that the spray of each spray jet on said roller extends at least to the spray of adjacent spray jets on said roller.

13. The apparatus of claim 1 or 4 wherein each spray jet includes an arcuate surface curved in two planes perpendicular to each other.

14. The apparatus of claim 4 wherein each spray jet includes a cupped surface for fanning out the sprayed gaseous fluid into a fan shaped spray.

15. Apparatus for dyeing continuously moving textile web comprising:

a roll applicator extending the width of the moving textile web and adapted to be mounted above the moving textile web, said roll applicator including a trough for supplying liquid dye, a roller mounted for rotation in said trough and adapted to pick up the dye in a film on a surface of the roller upon rotation of the roller, a doctor blade adjacent said roller and inclined downwardly away from said roller for transferring dye from said roller to said web, and a plurality of spaced spray jets for spraying fluid on said roller to rearrange said dye film, said spray jets being spacd sufficiently close together such that the spray of each spray jet on said roller extend at least to the spray of adjacent spray jets on said roller.

* * * * *